US008585790B2

(12) United States Patent
Swedek et al.

(10) Patent No.: US 8,585,790 B2
(45) Date of Patent: Nov. 19, 2013

(54) TREATMENT OF POLISHING PAD WINDOW

(75) Inventors: Boguslaw A Swedek, Cupertino, CA (US); Dominic J Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 721 days.

(21) Appl. No.: 12/761,334

(22) Filed: Apr. 15, 2010

(65) Prior Publication Data

US 2010/0269417 A1 Oct. 28, 2010

Related U.S. Application Data

(60) Provisional application No. 61/172,172, filed on Apr. 23, 2009.

(51) Int. Cl.
*B29C 39/00* (2006.01)
*B29C 59/00* (2006.01)

(52) U.S. Cl.
USPC ..... 51/298; 51/293

(58) Field of Classification Search
None
See application file for complete search history.

(56) References Cited

U.S. PATENT DOCUMENTS 3,784,655 A * 1/1974 Lewchuk ..... 264/2.3
5,578,362 A * 11/1996 Reinhardt et al. ..... 428/147
5,893,796 A 4/1999 Birang et al.
6,994,607 B2 2/2006 Wiswesser
2004/0127145 A1* 7/2004 Takahashi et al. ..... 451/6
2004/0209066 A1 10/2004 Swisher et al.
2006/0254706 A1 11/2006 Swisher et al.
2007/0037488 A1* 2/2007 Saikin ..... 451/6
2007/0049167 A1* 3/2007 Swedek et al. ..... 451/6

FOREIGN PATENT DOCUMENTS

JP 2008/246639 10/2008

OTHER PUBLICATIONS efunda.com, Polymer Material Properties_Polyurethane, Oct. 2007, http://web.archive.org/web/20071020052340/http://www.efunda.com/materials/polymers/properties/polymer_datasheet.cfm?MajorID=PU&MinorID=4.*

Korean Intellectual Property Office, Chang Yong Lee, Authorized Officer, International Search Report and Written Opinion of PCT/US2010/032253 dated Dec. 7, 2010.

* cited by examiner

*Primary Examiner* — Kaj K Olsen
*Assistant Examiner* — Jared Wood
(74) *Attorney, Agent, or Firm* — Fish & Richardson P.C.

(57) ABSTRACT

A window of solid light-transmissive polymer is formed in a polishing pad, and at least one surface of the window is treated to increase the smoothness of the at least one surface. Treating the surface of the window can include heating the at least one surface and pressing with a solid rigid part.

16 Claims, 4 Drawing Sheets

TREATMENT OF POLISHING PAD WINDOW

CROSS-REFERENCE TO RELATED APPLICATIONS

This application claims priority to U.S. application Ser. No. 61/172,172, filed on Apr. 23, 2009.

TECHNICAL FIELD

This disclosure relates to fabricating a polishing pad for use in chemical mechanical polishing (CMP).

BACKGROUND

In the process of fabricating modern semiconductor integrated circuits (IC), it is often necessary to planarize the outer surface of a substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a method of forming a window in a polishing pad includes forming a window of solid light-transmissive polymer in a polishing pad, and treating at least one surface of the window to increase the smoothness of the at least one surface.

Implementations may include one or more of the following. Treating at least one surface of the window can be performed after the window is formed in the polishing pad. Forming the window can include placing a body of solid light-transmissive polymer in a mold, dispensing liquid polishing pad precursor into the mold, curing the liquid precursor to form a body including solid polishing material molded to the body of solid light-transmissive polymer, and cutting a polishing pad having a portion of the solid polishing material and a portion of the body of solid light-transmissive polymer. Forming the window can include forming a top surface of the window closer to a polishing surface of the polishing layer and a bottom surface closer to a lower surface of the polishing layer. The top surface can be substantially flush with the polishing surface and the bottom surface can be substantially flush with the lower surface. Treating can include treating the top and/or bottom surface of the window. Treating the at least one surface can include heating the at least one surface, e.g., applying a heated body to the at least one surface, optionally with pressing the heated body on the at least one surface, e.g., ironing the at least one surface. The body can be heated to a temperature equal to or greater than 150° C., e.g., between 150° C. and 250° C., e.g., about 200° C. The solid light-transmissive polymer can be polyurethane. Heating the at least one surface can raise a temperature of the at least one surface above a glass transition temperature of the solid light-transmissive polymer. Treating the at least one surface can include applying a solvent to the at least one surface. The polishing pad may include a polishing layer formed of polyurethane with microsphere fillers.

Potential advantages may include one or more of the following. Transmission of light through the window can be increased, thereby reducing noise and increasing the reliability of endpoint detection. Pad-to-pad nonuniformity in window transmission can be reduced. Other features and advantages invention will be apparent from the description and drawings, and from the claims.

DETAILED DESCRIPTION

One potential problem in polishing pad manufacturing is roughness of the surface of the pad window. For example, the process of skiving can leave serrations, scratching, or other roughness on the window. This roughness can cause scattering, thus reducing the transmittance of the window, thus increasing noise in the optical monitoring system. However, by treating the window, e.g., with heat, the window surface can be smoothed. The smoother window has greater transmittance, thus decreasing noise in the optical monitoring system and improving reliability of endpoint detection. In addition, pad-to-pad nonuniformity in window transmission can be reduced.

Figure 1:
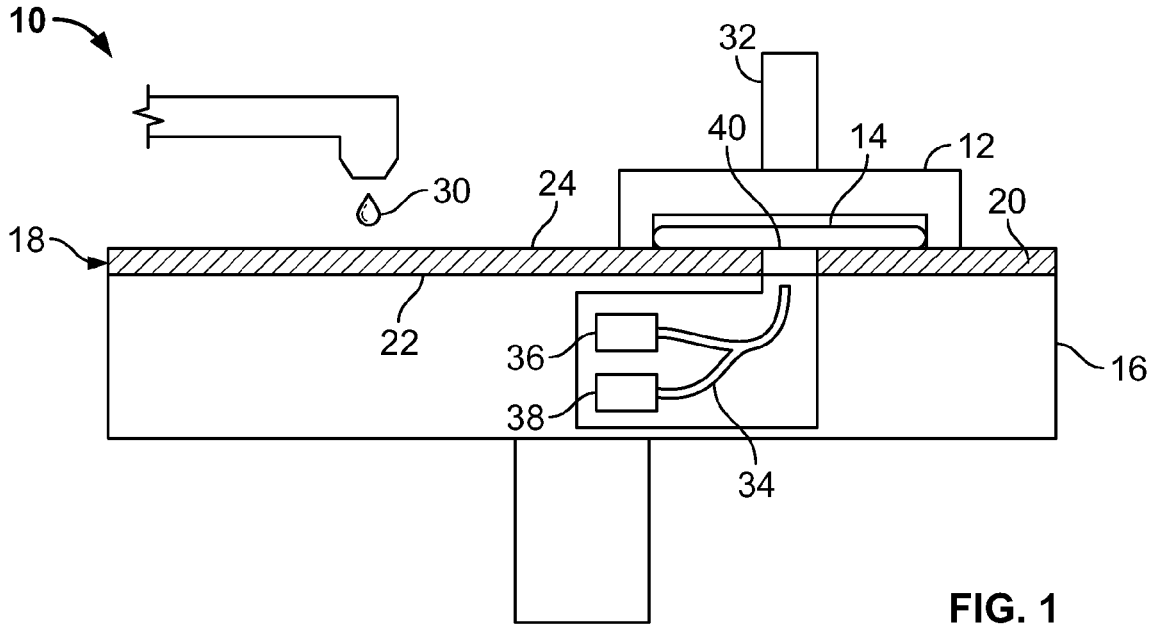
FIG. 1 is a schematic cross-sectional side view of a chemical mechanical polishing apparatus with an optical monitoring system for endpoint detection.

As shown in FIG. 1, a CMP apparatus 10 includes a polishing head 12 for holding a semiconductor substrate 14 against a polishing pad 18 on a platen 16.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. A polishing liquid 30, e.g., an abrasive slurry, can be distributed onto the polishing pad. The pressure and relative motion between the substrate and the polishing surface, in conduction with the polishing liquid, result in polishing of the substrate. A conditioner can abrade the surface of the polishing pad 18 to maintain the roughness of the polishing pad.

An optical monitoring system includes a light source 36, such as a white light source, and a detector 38, such as a photo spectrophotometer, in optical communication with a window 40 in the polishing pad 18. The light source and the detector can be located in and rotate with the platen 16, such that a monitoring light beam sweeps across the substrate once per platen rotation. For example, a bifurcated optical fiber 34 can carry light from the light source 36 through the platen 16 to be directed through the window 40 onto the substrate 14, and light reflected from the substrate 14 can pass back through the optical fiber 34 to the detector 38. Alternatively, the light source and the detector can be stationary components located below the platen, and an optical aperture can extend through the platen below the window 40 to intermittently pass the monitoring light beam to the substrate. The light source can employ a wavelength anywhere from the far infrared to ultraviolet, such as red light, although a broadband spectrum, e.g., white light, can also be used.

Figure 2:
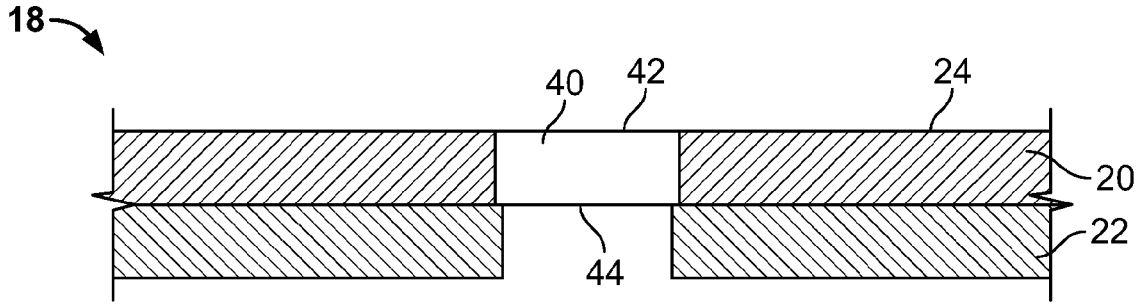
FIG. 2 is a simplified schematic cross-sectional view of a polishing pad with a window.

Referring to FIG. 2, the polishing pad 18 can include a polishing layer 20 with a polishing surface 24 to contact the substrate and a backing layer 22 adhesively secured to the platen 16. The polishing layer 20 can be a material suitable for bulk planarization of the exposed layer on the substrate. Such a polishing layer can be formed of a polyurethane material, e.g., with fillers, such as hollow microspheres, e.g., the polishing layer can be the IC-1000 material available from Rohm & Hass. The backing layer 22 can be more compressible than the polishing layer 20. In some implementations, the polishing pad includes only the polishing layer, and/or the polishing layer is a relatively soft material suitable for a buffing process, such as a poromeric coating with large vertically oriented pores. In some implementations, grooves can be formed in the polishing surface 24.

The window 40 can be a solid light-transmitting material, e.g., a transparent material, such as a relatively pure polyurethane without fillers. The window 40 can be joined to the polishing layer 20 without adhesive, e.g., the abutting edges of the window 40 and polishing layer 20 are molded together. The top surface of the window 40 can be coplanar with the polishing surface 24, and the bottom surface of the window 40 can be coplanar with the bottom of the polishing layer 20. The polishing layer 20 can completely surround the window 40. An aperture in the backing layer 22 is aligned with the window 40 in the polishing layer 20.

Figure 3:
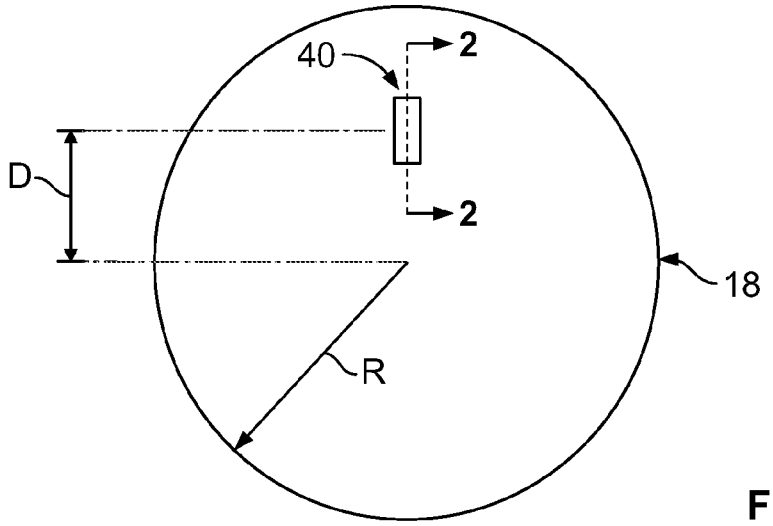
FIG. 3 is a simplified top view of the polishing pad of FIG. 2.

Referring to FIG. 3, in one implementation the polishing pad 18 has a radius R of 15.0 inches (381.00 mm), with a corresponding diameter of 30 inches. In other implementations, the polishing pad 18 can have a radius of 15.25 inches (387.35 mm) or 15.5 inches (393.70 mm), with corresponding diameter of 30.5 inches or 31 inches. The optical monitoring system can use an area about 0.5 inches (12.70 mm) wide and 0.75 inches (19.05 mm) long centered a distance D of 7.5 inches (190.50 mm) from the center of the polishing pad 18. Thus, the window should cover at least this area. For example, the window can have a length of about 2.25 (57.15 mm) inches and a width of about 0.75 inches (19.05 mm). Both the polishing pad and the window can have a thickness of about 0.02 to 0.20 inches, e.g., 0.05 to 0.08 inches (1.27 to 2.03 mm). The window 40 can have a rectangular shape with its longer dimension substantially parallel to the radius of the polishing pad that passes through the center of the window. However, the window 40 can have other shapes, such as circular or oval, and the center of the window need not be located at the center of the area used by the optical monitoring system.

Figure 4:
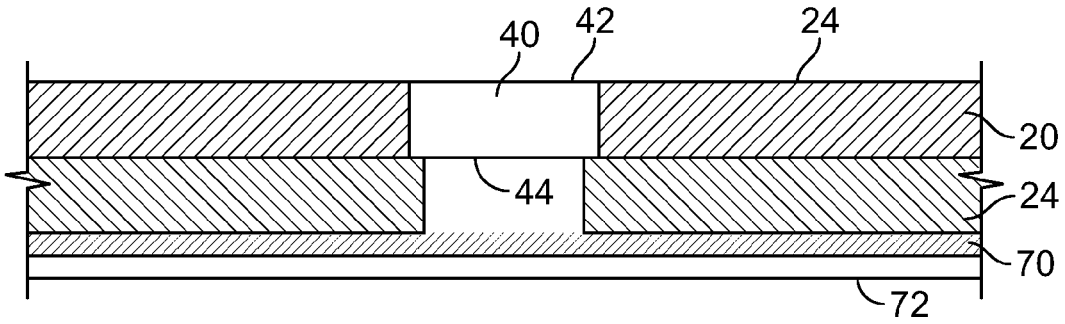
FIG. 4 is a simplified schematic cross-sectional view of a polishing pad with a pressure sensitive adhesive and liner.
Figure 5:
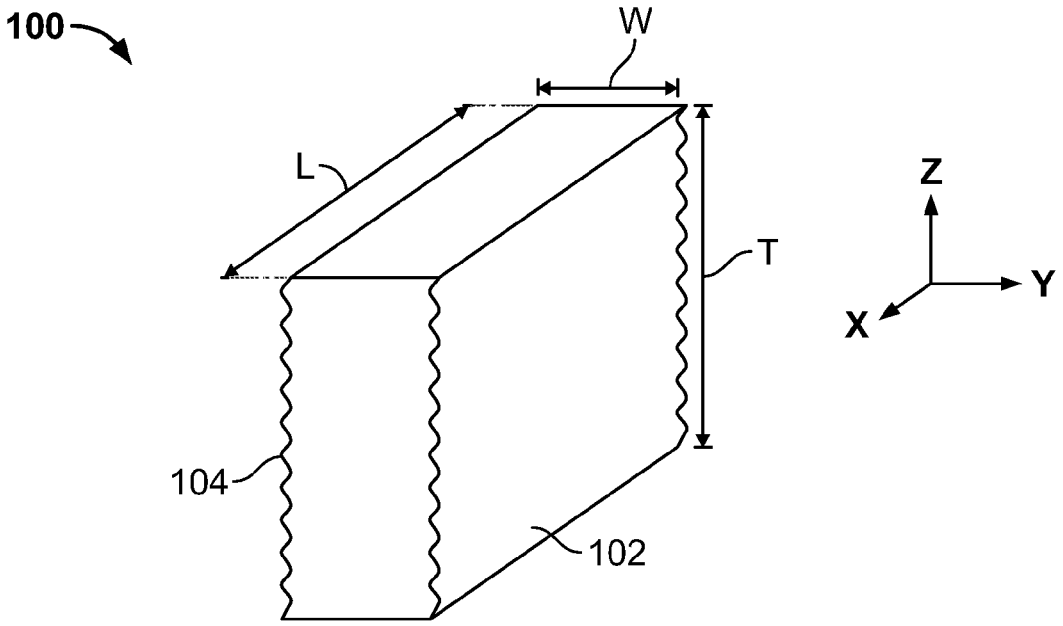
FIG. 5 is a schematic perspective view of a block of solid light-transmissive material for use in making a polishing pad window.

Referring to FIG. 4, before installation on a platen, the polishing pad 18 can also include a pressure sensitive adhesive 70 and a liner 72 that spans the bottom surface 23 of the polishing pad. In use, the liner 72 is peeled from the polishing layer 20, and the polishing pad 18 is applied to the platen with the pressure sensitive adhesive 70. The pressure sensitive adhesive 70 and liner 72 can span the window 40, or either or both can be removed in and immediately around the region of the window 40.

Turning now to FIGS. 5-9, a method of constructing a polishing pad will be discussed. Initially, a block 100 of solid light transmitting polymer material is formed. For example, a block of solid polyurethane, without fillers that inhibit transmission, can be cast and cut to desired dimensions. This block can have cross-sectional dimensions in an x-y plane that are the same as the window that will be formed in the polishing pad, but can be much thicker, e.g., at least ten times thicker, e.g., about twenty to fifty times thicker, in the z plane. For example, the window block can have a length L and thickness T of 2.25 (57.15 mm) inches and a width W of about 0.75 inches (19.05 mm). The side surfaces 102, 104 can be roughened, e.g., to improve adhesion to the polishing layer material during molding.

Figure 6:
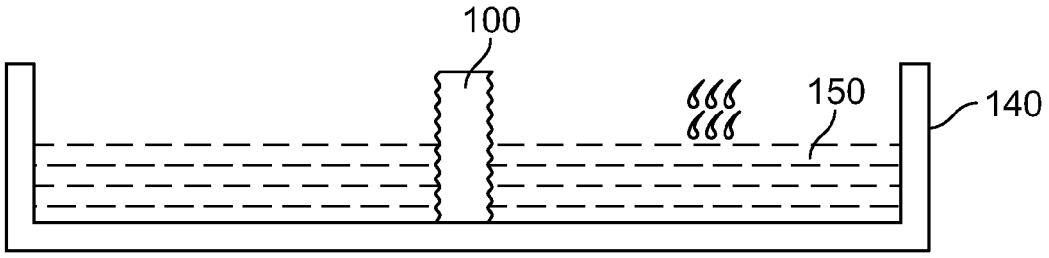
FIG. 6 is a schematic cross-sectional side view illustrating liquid polishing layer precursor in a mold with the block of solid light-transmissive material.

Referring to FIG. 6, the block 100 can be placed in a mold 140 which is then filled with a liquid precursor 150 of the polishing layer. The mold 140 can be filled to about the same height as the block 100, e.g., the block 100 can be submerged or the block 100 can project slightly above the liquid 150.

Figure 7:
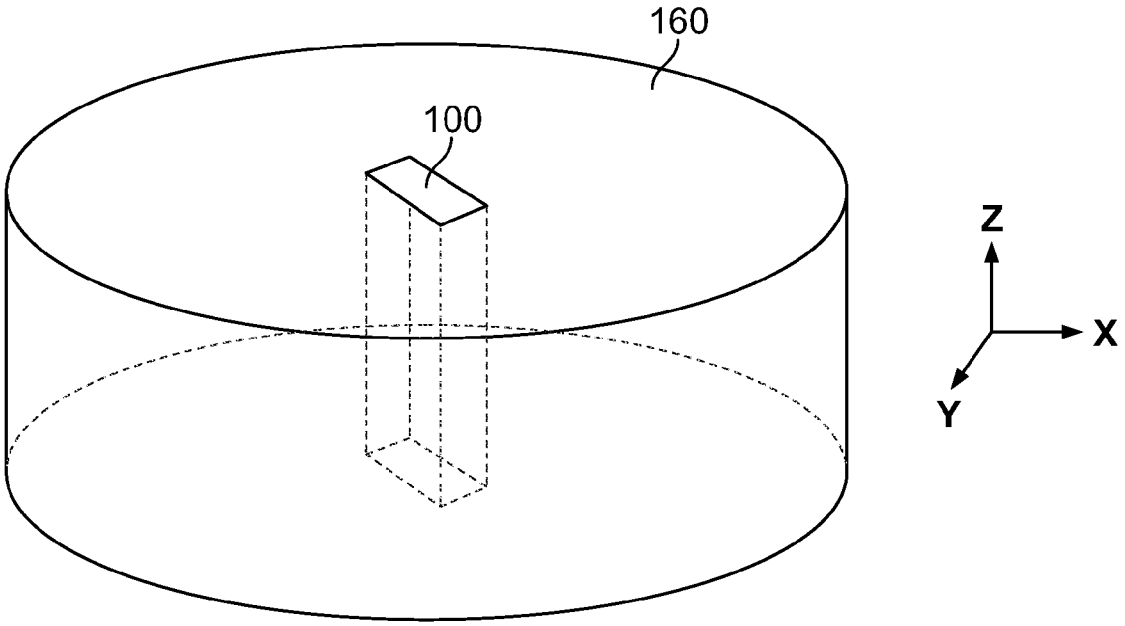
FIG. 7 is a schematic perspective view of a body of cured polishing material molded to the block of solid light-transmissive material.

Referring to FIG. 7, the liquid precursor is then cured, e.g., baked, and removed from the mold 140. For example, liquid polyurethane can be cured to form a solid plastic body 160 that is molded to the block 100. The plastic body 160 can have lateral dimensions in an xy plane substantially the same as or larger than the final polishing pad, e.g., a circular disk with a radius of 10 inches (254 mm), 15.0 inches (381.00 mm), 15.25 inches (387.35 mm), 15.5 inches (393.70 mm), 21 inches (533.40 mm) or 21.25 inches (539.75 mm), but can be much thicker than the final polishing pad, e.g., at least ten times thicker, along the z axis.

Figure 8:
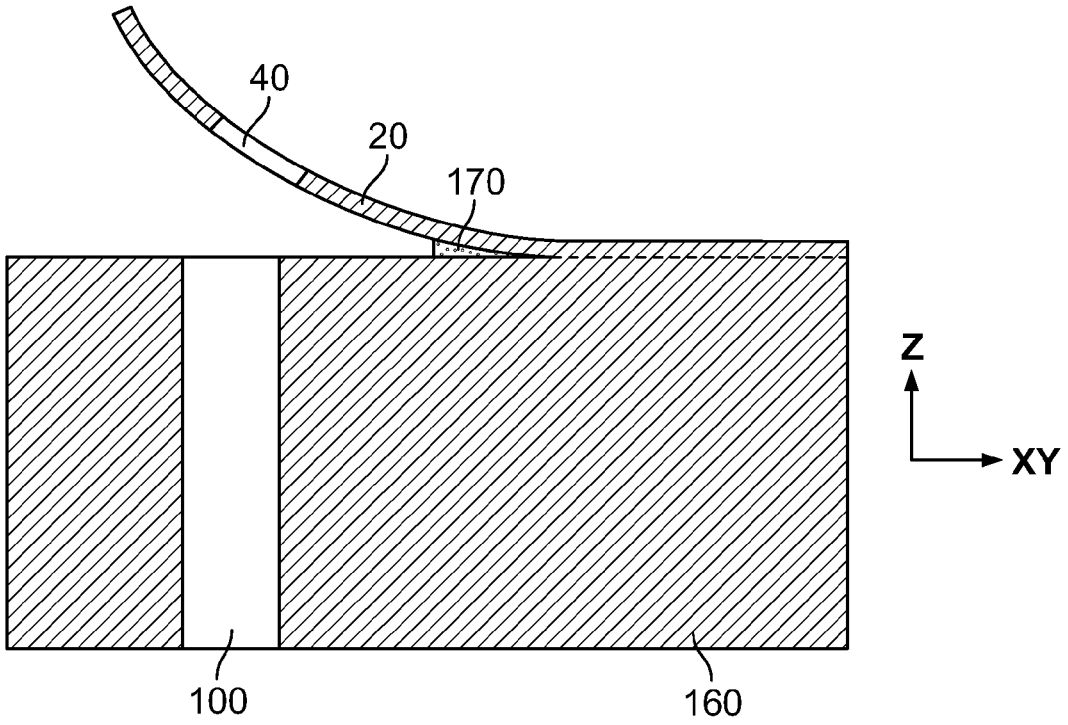
FIG. 8 is a schematic cross-sectional view of a polishing pad being skived from a body of cured polishing material.

Referring to FIG. 8, a thin polishing layer 20 is then cut from body 160, e.g., by skiving in the xy plane with a blade 170. Because the skiving cuts through the block 100, the skived portion of the block 100 forms a window 40 that is molded to the polishing layer 20.

The skiving process can leave small-scale (e.g., 5 to 200 micron deep) surface irregularities, such as scratching, serrations or other roughness, on both the top surface 42 and the bottom surface 44 of the window 40. With respect to the top surface, the presence of water or slurry during polishing can provide partial index-matching to the pad material, which can reduce the tendency of the surface irregularities to cause scattering as the light beam passes through the window top surface. However, if the bottom surface of the window interfaces with air, then the surface irregularities can cause scattering as the light beam passes through the window bottom surface, thus reducing the transmittance of the window and increasing noise in the optical monitoring system as discussed above.

After the window has been skived, the top and/or bottom surface of the window 40 can be treated to reduce the surface irregularities and increase surface smoothness, thereby decreasing the tendency of the window surfaces to scatter light.

As one example, the surface of the window can be heated to slightly soften the window, permitting the surface to be flow or pressed flat. For example, the window material can be raised sufficiently that the window remains solid but can deform more easily to reach a smooth surface condition, e.g., so that the window material is capable of plastic deformation without fracture. For example, the window material can be raised to or above its glass transition temperature. Also, if the window material is already in a glassy phase at room temperature, application of heat can further soften the window material. However, the temperature need not be raised above the melting of the window material. The deformation could be in response to gravity with the pad material flowing and self-leveling, or in response to pressure from a solid rigid part. For example, the manufacturer can press a heated rigid part against the already solidified window material (but optionally not against the rest of the polishing layer 20) to press out the surface irregularities and leave the window surface significantly smoother than after the skiving process. The heated part can be moved laterally across the window to smooth out the surface irregularities, e.g., effectively the window can be ironed flat.

In general, at lower temperatures, higher pressure must be applied with the rigid part to press out the surface irregularities. On the other hand, the temperature should not be so high that the window material melts or burns.

In some implementations, e.g., for a urethane-based window, the surface of the heated part that will contact the window can be raised to a temperature above 150° C., e.g., to a temperature between 150° C. and 250° C., e.g., to a temperature of about 200° C.

In some implementations, the window material can be subjected to polishing in conjunction with heat treatment.

Figure 9:
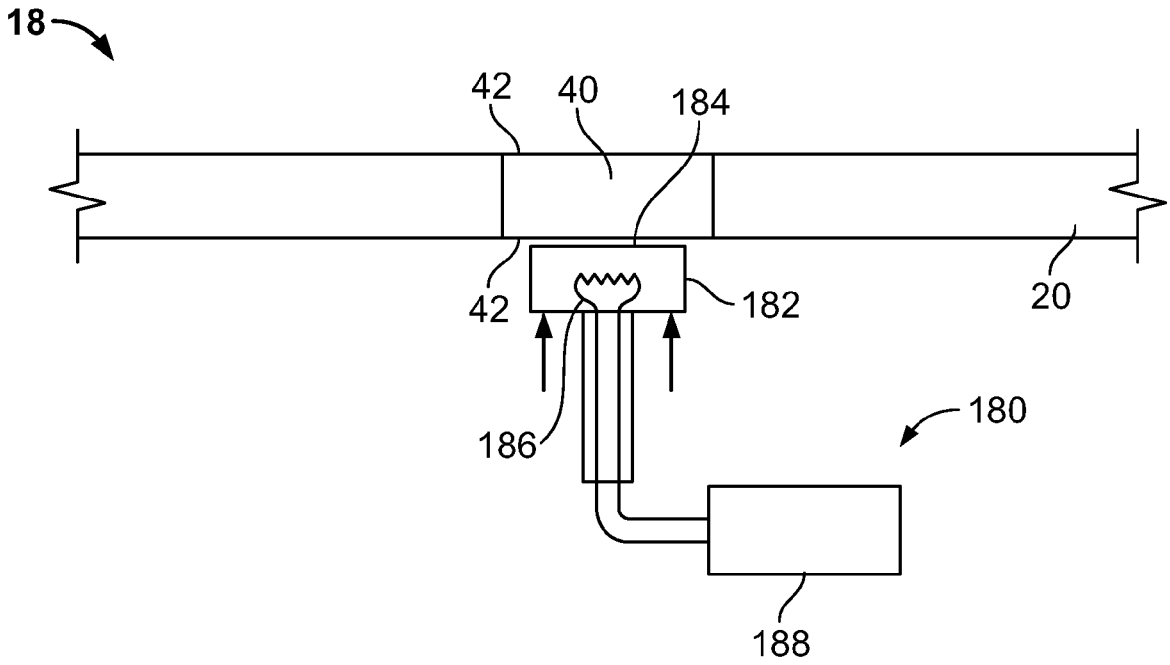
FIG. 9 is a schematic cross-sectional view of a polishing pad window being heat treated.

Referring to FIG. 9, a heating system 180 can include a rigid thermally conductive body 182 with a smooth surface 184, e.g., a metal plate, that is applied to a surface, e.g., the bottom surface 44, of the window 40. The body 182 can be heated, e.g., by a resistive heating element 186 connected to a power supply 188. The resistive heating element 186 can be embedded in the thermally conductive body 182 as shown, or a separate part attached to the thermally conductive body 182. For example, they heating system could be a consumer ironing appliance, or a soldering iron having the tip fitted with a thermally conductive plate.

If the polishing pad 18 includes a backing layer 22, the polishing layer 20 with molded window 40 can be secured to the backing layer 22, e.g., with a pressure sensitive adhesive, before or after treatment of the window 40.

As another example of surface treatment, a chemical solvent can be applied to the top and/or bottom window surface to dissolve away scratches or surface irregularity. Urethane solvents are commercially available.

A number of embodiments have been described. Nevertheless, it will be understood that various modifications may be made without departing from the spirit and scope of the disclosure. For example, although described above in the context of a window that is molded to a polishing layer, the window could be skived from a block and then secured in a hole in the polishing layer, e.g., by adhesive. In this case, the window could be treated before or after being installed in the polishing pad. In addition, processes other than skiving, e.g., molding, could result in surface irregularities on the window surface. Accordingly, other embodiments are within the scope of the following claims.

What is claimed is:

1. A method of making a polishing pad, comprising:

forming a window of solid light-transmissive polymer in the polishing pad; and treating at least one surface of the window to increase smoothness of the at least one surface by pressing a heated rigid part against the at least one surface while moving the heated rigid part laterally across the at least one surface of the window.

2. The method of claim 1, wherein treating at least one surface of the window is performed after the window is formed in the polishing pad.

3. The method of claim 1, wherein forming the window includes placing a body of solid light-transmissive polymer in a mold, dispensing liquid polishing pad precursor into the mold, curing the liquid precursor to form a casting including solid polishing material molded to the body of solid light-transmissive polymer, and cutting the casting to form a polishing pad having a portion of the solid polishing material and a portion of the body of solid light-transmissive polymer.

4. The method of claim 1, wherein forming the window includes forming a top surface of the window closer to a polishing surface of the polishing pad and a bottom surface closer to a lower surface of the polishing pad.

5. The method of claim 4, wherein the top surface is substantially flush with the polishing surface and the bottom surface is substantially flush with the lower surface.

6. The method of claim 4, wherein treating includes treating the top surface of the window.

7. The method of claim 4, wherein treating includes treating the bottom surface of the window.

8. The method of claim 1, wherein the part is heated to a temperature equal to or greater than 150° C.

9. The method of claim 8, wherein the temperature is between 150° C. and 250° C.

10. The method of claim 9, wherein the temperature is about 200° C.

11. The method of claim 8, wherein the solid light-transmissive polymer comprises polyurethane.

12. The method of claim 1, wherein heating the at least one surface raises a temperature of the at least one surface above a glass transition temperature of the solid light-transmissive polymer.

13. The method of claim 12, wherein heating the at least one surface does not raise the temperature of the at least one surface above a melting temperature of the solid light-transmissive polymer.

14. The method of claim 1, wherein the polishing pad comprises a polishing layer formed of polyurethane with microsphere fillers.

15. The method of claim 1, wherein treating comprises heating and pressing against only one surface of the window.

16. The method of claim 1, wherein the heated rigid part is a consumer ironing appliance.

* * * * *